US012329269B2

(12) United States Patent
Gustafsson

(10) Patent No.: US 12,329,269 B2
(45) Date of Patent: Jun. 17, 2025

(54) BACKPACK AND METHOD OF PRODUCING THE SAME

(71) Applicant: USWE Sports AB, Malmo (SE)

(72) Inventor: Jörgen Gustav Gustafsson, Malmo (SE)

(73) Assignee: USWE Sports AB, Malmo (SE)

( * ) Notice: Subject to any disclaimer, the term of this patent is extended or adjusted under 35 U.S.C. 154(b) by 771 days.

(21) Appl. No.: 17/080,492

(22) Filed: Oct. 26, 2020

(65) Prior Publication Data

US 2021/0127815 A1 May 6, 2021

(30) Foreign Application Priority Data

Oct. 31, 2019 (SE) ..... 1930353-6

(51) Int. Cl.
*A45F 3/04* (2006.01)
*A45F 3/00* (2006.01)

(52) U.S. Cl.
CPC ..... *A45F 3/04* (2013.01); *A45F 2003/001* (2013.01); *A45F 2003/045* (2013.01)

(58) Field of Classification Search
CPC ..... A45F 3/04; A45F 2003/045
See application file for complete search history.

(56) References Cited

U.S. PATENT DOCUMENTS 3,522,640 A 8/1970 Lohr
D329,210 S 9/1992 Cullmann
5,319,836 A 6/1994 Ida
D349,871 S 8/1994 Murai
D360,390 S 7/1995 Murai
D373,975 S 9/1996 Anscher
6,095,389 A * 8/2000 Fenton ..... A45C 13/26 224/259
D638,332 S 5/2011 Fair
7,980,771 B2 7/2011 Chamberlayne
D768,755 S 10/2016 Thomas et al.
D768,757 S 10/2016 Thomas et al.
D772,969 S 11/2016 Drunker et al.
D780,438 S 3/2017 Marques et al.
9,585,462 B2 3/2017 Engdahl et al.
D800,823 S 10/2017 Drunker et al.
D805,427 S 12/2017 Steinberger
(Continued)

FOREIGN PATENT DOCUMENTS

EM EU 008202311-0003 10/2020
EP 3072413 A1 * 9/2016 ..... A45F 3/04
GB 9008202311-0001 10/2020

OTHER PUBLICATIONS

Swedish Office Action for Application No. 1930353-6, dated Apr. 2, 2020, in 6 pages.

(Continued)

*Primary Examiner* — Justin M Larson
(74) *Attorney, Agent, or Firm* — Knobbe, Martens, Olson & Bear, LLP

(57) ABSTRACT

A backpack may include a wind and heat insulating material, the wind and heat insulating material forming a body heated compartment. The backpack may further comprise a seal. The seal may be connected to the body heated compartment and configured to contact a user of the backpack such that the body heated compartment is at least partly sealed against the user.

19 Claims, 6 Drawing Sheets

(56) References Cited

U.S. PATENT DOCUMENTS

| | | | | |
|---|---|---|---|---|
| D805,953 | S | 12/2017 | Salomonsson | |
| D806,382 | S | 1/2018 | Beard et al. | |
| D806,779 | S | 1/2018 | Martin et al. | |
| D851,162 | S | 6/2019 | Bergman et al. | |
| D880,850 | S | 4/2020 | Romani et al. | |
| D915,934 | S | 4/2021 | Paik et al. | |
| D923,688 | S | 6/2021 | Gustafsson | |
| D977,365 | S | 2/2023 | Zhao | |
| D991,827 | S | 7/2023 | Zepic | |
| 2006/0151534 | A1 | 7/2006 | Mares | |
| 2007/0214617 | A1 | 9/2007 | Niwa | |
| 2009/0095773 | A1* | 4/2009 | Pinne | A45F 5/02 220/592.2 |
| 2009/0314813 | A1 | 12/2009 | Woolery | |
| 2010/0181353 | A1 | 7/2010 | Craighead | |
| 2010/0276464 | A1 | 11/2010 | Hirt et al. | |
| 2011/0101050 | A1 | 5/2011 | Parazynski et al. | |
| 2014/0140686 | A1 | 5/2014 | Weihe | |
| 2015/0323858 | A1 | 11/2015 | Stephens et al. | |
| 2017/0115095 | A1 | 4/2017 | Moultrie et al. | |
| 2017/0231371 | A1 | 8/2017 | Li et al. | |
| 2019/0059331 | A1 | 2/2019 | Lai | |
| 2019/0137160 | A1 | 5/2019 | Larsen | |
| 2020/0008537 | A1 | 1/2020 | Sepe et al. | |

OTHER PUBLICATIONS

Award Winner—The USWE Action Camera Harness. [online] Retrieved Mar. 23, 2021 from URL: https://www.uswe-sports.com/stories/post/award-winner-the-uswe-action-camera-harness.

Tebru Gopro Chest Mount Harness, Chest Mount Harness, TELESIN Adjustable Body Chest Strap Mount Harness Belt for Gopro Hero 5/4/3+/3 Sport Camera. [online] Retrieved Mar. 23, 2021 from URL: https://www.walmart.com/ip/Tebru-Gopro-Chest-Mount-Harness-Chest-Mount-Harness-TELESIN-Adjustable-Body-Chest-Strap-Mount-Harness-Bel.

* cited by examiner

BACKPACK AND METHOD OF PRODUCING THE SAME

TECHNICAL FIELD

The invention relates to a backpack. More specifically to a backpack with a compartment heated by body heat from a user of the backpack.

BACKGROUND

Today, when using a backpack in colder environments there is a risk of accessories in the backpack, such as mobile phones or for the backpack, such as hydration tubes with a mouth piece, to freeze and stop working. This can be due to the temperature itself being below 0 degrees Celsius or the wind pushing the temperature below 0 degrees Celsius when e.g. running or driving a motor cross bike.

To deal with the low temperatures there are different solutions to further insulate the accessories such as the hydration tube or the mouth piece by adding covers made from an insulating material around them. For instance, you can get different types of covers for your hydration tube that completely covers the hydration tube depending on a desired temperature use.

This means that you need to buy a specific cover depending on the type of backpack you have or accessory you have and the desired temperature use. Thus, today there is a need for a plurality of specific covers or insulation.

Hence, improvements to backpacks for dealing with colder weather is desirable.

SUMMARY

It is, therefore, an object of the present invention to at least overcome or alleviate some of the above described problems.

According to a first aspect, a backpack comprising a wind and heat insulating material. The wind and heat insulating material forms a body heated compartment, and a seal, the seal is connected to the body heated compartment and the seal is configured to contact a user of the backpack such that at least partly sealing the body heated compartment against the user.

According to a second aspect, a method for producing a backpack comprising a body heated compartment. The method comprised forming the body heated compartment by use of a wind and heat insulating material, and arranging a seal at the body heated compartment, the seal is arranged and configured to contact a user of the backpack such that at least partly sealing the body heated compartment against the user.

Further examples of the disclosure are defined in the dependent claims, wherein features for the third and subsequent aspects of the disclosure are as for the first to second aspects mutatis mutandis.

Some examples of the disclosure provide for a seal being an oblique end or oblique ends.

Some examples of the disclosure provide for a seal configured to be flexible.

Some examples of the disclosure provide for a seal that will flex towards a user when a body heated compartment is stretched.

Some examples of the disclosure provide for a heat transfer material that allows body heat to pass through.

Some examples of the disclosure provide for a heat transfer material being arranged closer than a wind and heat insulating material to a user, when worn.

Some examples of the disclosure provide for a wind and heat insulating material is connected with a heat transfer material for forming a body heated compartment.

Some examples of the disclosure provide for a wind and heat insulating material being connected with a heat transfer material by being sewn together.

Some examples of the disclosure provide for at least one shoulder strap of a backpack comprising a body heated compartment.

Some examples of the disclosure provide for a body heated compartment comprising an opening.

Some examples of the disclosure provide for an opening is re-closable.

Some examples of the disclosure provide for an opening being arranged at an end of a shoulder strap.

Some examples of the disclosure provide for an opening being arranged at a side of a shoulder strap.

Some examples of the disclosure provide for a backpack further comprising at least two waist straps.

A backpack as discussed throughout this disclosure general fall into one of four categories: frameless, external frame, internal frame, and bodypack. All these backpacks have some common and well-known features such as shoulder straps connected to a bag or sack. Most backpacks are capable of being closed with for example a buckle mechanism or a zipper.

BRIEF DESCRIPTION OF THE DRAWINGS

Examples of the invention will now be described, by way of examples, with reference to the accompanying schematic drawings, in which.

DETAILED DESCRIPTION

Figure 1:
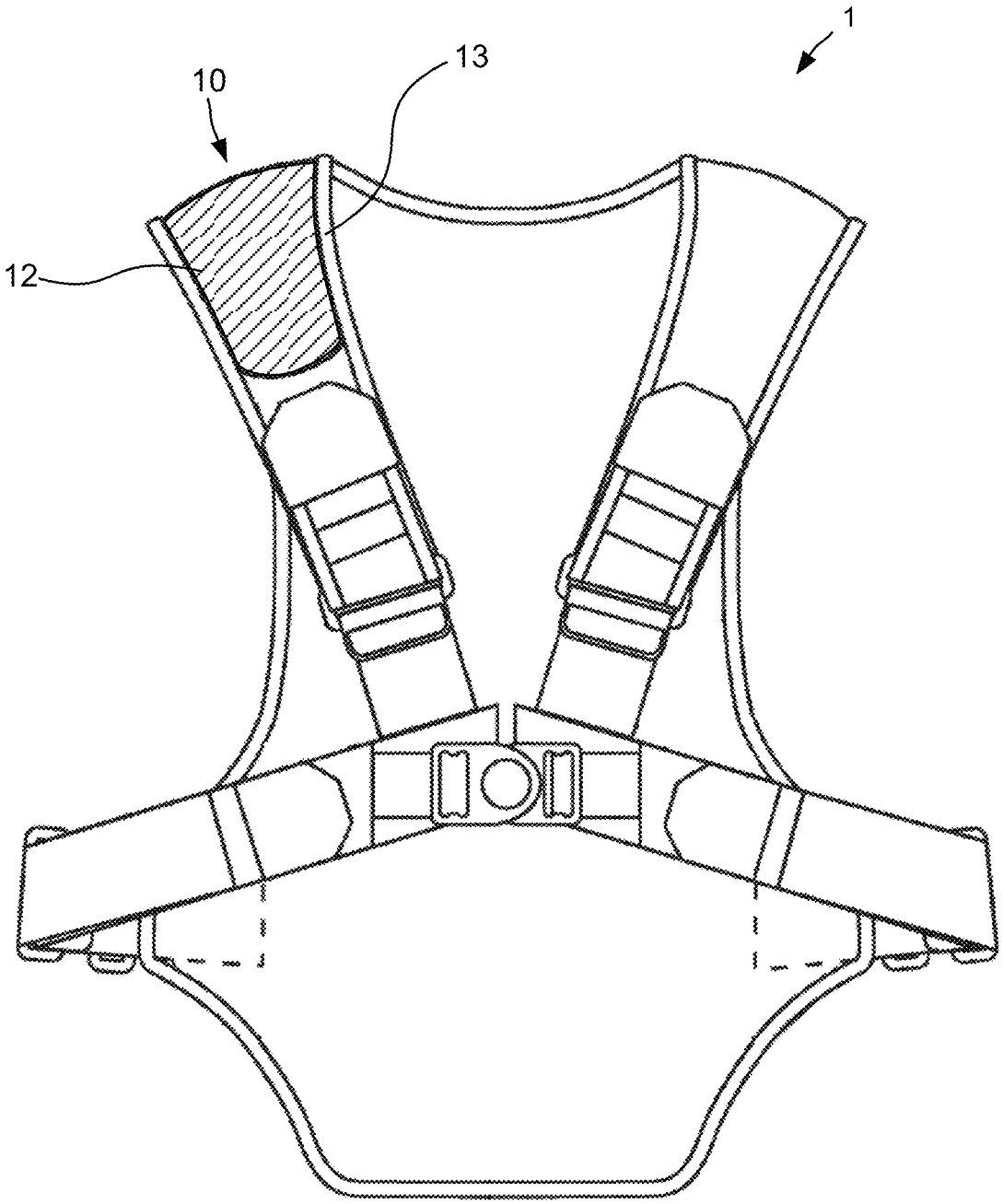
FIG. 1 is a front view of a backpack comprising a wind and heat insulating material forming a body heated compartment and a seal.

FIG. 1 is a front view of an example of a backpack 1 comprising a wind and heat insulating material 12 forming a body heated compartment 10. The backpack 1 further comprises a seal 13. The seal 13 is configured to contact a user of the backpack such that at least partly sealing the body heated compartment 10 against the user.

The seal 13 is illustrated in FIG. 1 to partly be arranged along vertical edges of the body heated compartment 10. In some examples the seal 13 will be arranged along horizontal edges of the body heated compartment 10. In some examples the seal 13 will be arranged to completely enclose the body heated compartment 10. At least partly may in this application mean that the seal 13 is at least partly arranged along a circumference of the body heated compartment 10, as discussed above, and/or that the seal 13 is at least partly air tight.

Figure 2:
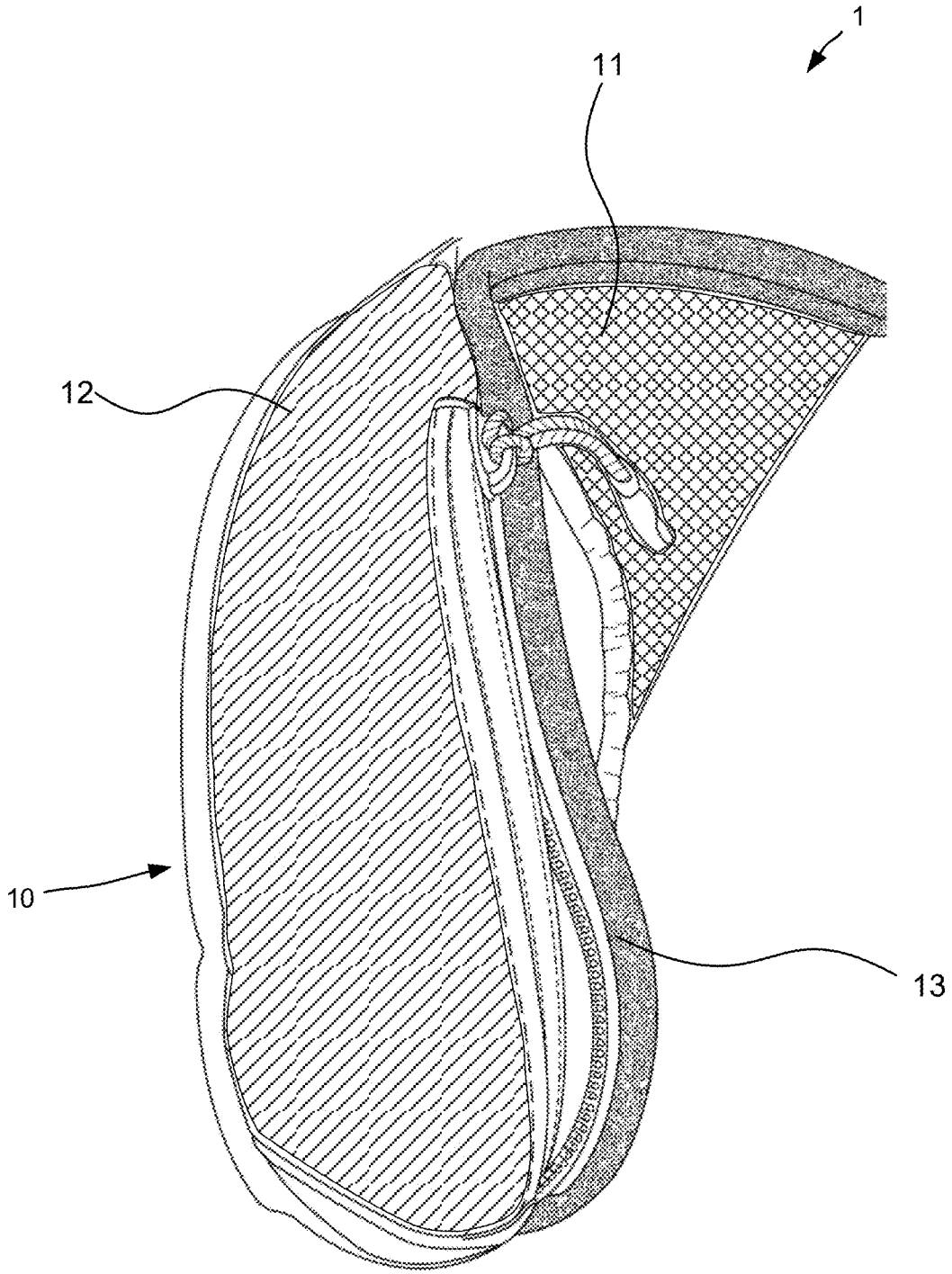
FIG. 2 is a perspective view of a body heated compartment comprising a heat transfer material, a wind and heat insulating material and a seal.

The seal 13 is illustrated in some of the accompanying figures, e.g. FIG. 1, to be directly connected to the wind and heat insulating material 12, however in some examples there are additional materials or other elements arranged between the seal 13 and the wind and heat insulating material 12, e.g. FIG. 2 having a zipper arranged between the seal 13 and the wind and heat insulating material 12. In some examples, the seal 13 may also comprise several materials, such as a soft and tough outer fabric and internal padding.

The wind and heat insulating material 12 combined with the seal 13 will allow for body heat from the user of the backpack 1 to heat the body heated compartment 10. Since the seal 13 is configured to contact or maybe even press against the user of the backpack 1 and acting as an interface between the body heated compartment 10 and the user of the backpack 1, a substantially body heated leakage free body heated compartment 10 is formed. Thus, the body heated compartment 10 is an open compartment or pocket that is open against the user such that the heat from the user can easily enter into the body heated compartment 10 and heat any items in the compartment or pocket.

The wind and heat insulating material 12 can also protect an inside of the body heated compartment 10 from being cooled by air or wind blowing on the body heated compartment 10. The seal 13 can also prevent any wind or air from entering into the body heated compartment 10 between the user and the body heated compartment 10.

By allowing body heat to warm up the body heated compartment 10 any items in the body heated compartment 10 can e.g. be kept above at least a freezing point. Preferably the temperature in the body heated compartment 10 can reach at least 10, 15 or 20 degrees Celsius.

The wind and heat insulating material 12 may comprise any one of and/or a combination of at least a biaxially-oriented polyethylene terephthalate, a metalized biaxially-oriented polyethylene terephthalate, an ultra-high-molecular-weight polyethylene, a stretched polytetrafluoroethylene, a neoprene, tarpaulin, a chlorosulfonated polyethylene synthetic rubber, a nylon and/or a polyester.

In an example illustrated in e.g. FIG. 2, the seal 13 is an oblique end. In some examples, the seal 13 is made of a plurality of oblique ends. In the illustrated example, the seal 13 is formed by a soft material that is wrapped around an end of the wind and heat insulating material 12 and sewn together. The seal 13 may a part of an integral and continuing end of the backpack 1, as illustrated in e.g. FIG. 1. The seal 13 may therefore also be a connection between two sections of the backpack 1 as for example illustrated in FIG. 1, wherein the seal 13 connects a distal section comprising a buckle to a proximal section comprising the bag of the backpack 1.

The seal 13 may also be a separate part from the backpack 1 or a section of the backpack 1. In an example, the seal 13 has an enlarged contact surface that further improves the contact between the user and the body heated compartment 10. In an example, the seal 13 may be connected or attached to the body heated compartment 10 by gluing, velcro, a zipper or other fastening or temporary fastening mechanisms.

In an example, the seal 13 is flexible and is configured to flex towards the user. In an example, the seal 13 is flexible and will flex towards the user when the body heated compartment 10 is stretched in a direction of extension of the body heated compartment 10. This allows for the seal 13 to be pressed with a force against the user for an even better fit to the user and thus directing even more body heat into the body heated compartment 10.

Thus, if the user is e.g. running, the backpack 1 will move around and the seal 13 will be more or less pressed against the body of the user since the body heated compartment 10 will be stretched to various degrees based on the movement of the backpack 1. In an example, the stretching of the body heated compartment 10 is in a vertical or horizontal direction relative to an extension of the body heated compartment 10.

In some examples, the backpack 1 further comprises a heat transfer material 11, illustrated in e.g. FIG. 2. The heat transfer material 11 is arranged closer to the user than the wind and heat insulating material 12, when the backpack 1 is worn. The heat transfer material 11 can be any one of and/or a combination of a polyester, cotton, nylon, natural textiles or materials, textiles or materials that will let heat through.

In an example the heat transfer material 11 allows more heat to pass into the body heated compartment 10 than the wind and heat insulating material 12 lets body heated air out or protects wind from cooling down the body heated compartment 10. In some examples, at least 50%, or at least 70% or at least 80%, or at least 90% of the body heat pass through the heat transfer material 11. In some examples, the wind and heat insulating material 12 insulates at least 50%, or at least 70% or at least 80%, or at least 90% of the body heat inside the body heated compartment 10.

The heat transfer material 11 and/or wind and heat insulating material 12 can be a textile or comprise a majority of textile. The heat transfer material 11 and/or wind and heat insulating material 12 may be made as a mesh. The heat transfer material 11 and/or wind and heat insulating material 12 can also be made up by a plurality of textiles.

In some examples the heat transfer material 11 is a same material as an outer piece of clothes of a user so that a good heat transfer of the body heat from the user to the body heated compartment 10 is achieved. In an example, the heat transfer material 11 is of a different material than the outer piece of clothes of the user and the heat transfer material has a better heat transfer, i.e. allows more heat to pass through, than the outer piece of clothes of the user.

Textiles and/or materials may be layered on top of each other for creating the heat transfer material 11 and/or wind and heat insulating material 12. For example, the heat transfer material 11 may be made from two different layers wherein a first layer is a thin coherent textile and a second layer is a mesh textile. The thin coherent layer will prevent dust or other particles from entering the body heated compartment 10 and the mesh textile will provide strength to the heat transfer material 11 and/or the body heated compartment 10, as well as allowing body heat to pass through the two layer heat transfer material 11.

The heat transfer material 11 may be made as a piece that covers a similar surface as the wind and heat insulating material 12. In some examples, the heat transfer material 11 is made as discussed above, as a mesh, thus covering less surface than the wind and heat insulating material 12.

In some examples, the heat transfer material 11 is made as a bar(s) or strip(s) that extend between the seal 13 for maintaining an open body heat channel into the body heated compartment 10. Hence, the shape of the heat transfer material 11 and/or wind and heat insulating material 12 can be made in a variety of ways and some may depend on e.g. maintaining a structure of the backpack 1, the design of the backpack 1 and so on.

The heat transfer material 11 and/or wind and heat insulating material 12 may be a same material as other materials of the backpack 1. The heat transfer material 11 and/or wind and heat insulating material 12 may in some examples be different.

The heat transfer material 11 and wind and heat insulating material 12 may be connected to each other forming the body heated compartment 10. The heat transfer material 11 and wind and heat insulating material 12 may be connected to each other by e.g. being glued together, connected by a zipper, connected by an adhesive, velcro tape, sewn together or a combination of the above.

The connection between the heat transfer material 11 and wind and heat insulating material 12 may also comprise further materials arranged between and/or around ends of the heat transfer material 11 and/or the wind and heat insulating material 12, as discussed above. Thus, the body heated compartment 10 may be formed by a majority of the heat transfer material 11 and wind and heat insulating material 12 but also comprise further materials. In some examples, the body heated compartment 10 comprises only the heat transfer material 11, the wind and heat insulating material 12 and the seal 13.

The body heated compartment 10 can be of any size such as a size for holding a mobile phone and/or a hydration bladder. The body heated compartment 10 may also be a complete sack of the backpack 1. Waist straps of the backpack 1 may comprise the body heated compartment 10. In some examples the size and/or location of the body heated compartment 10 is selected based on the anatomy of a user, a prominent heat zone of a user's body or a comfort of the user.

Figure 3:
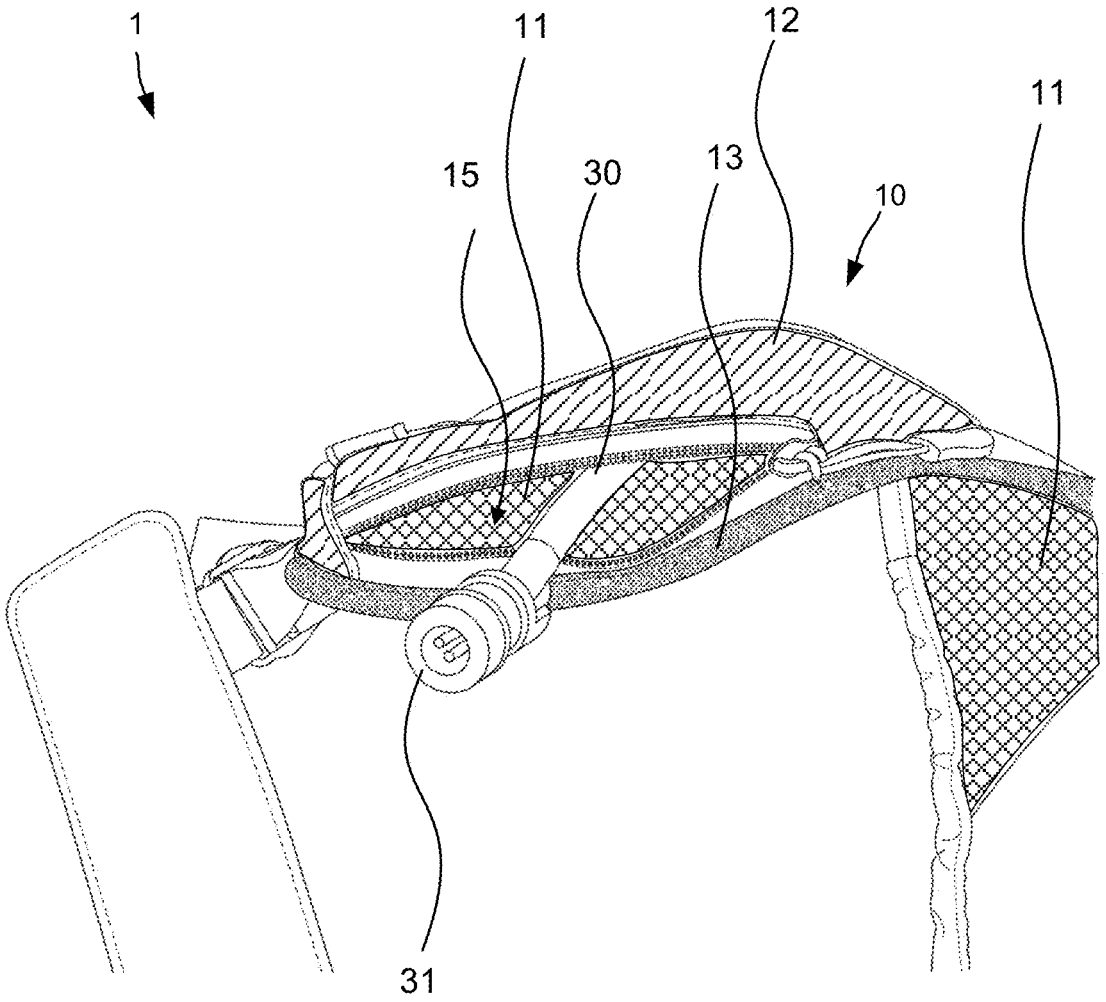
FIG. 3 is a perspective view of a body heated compartment comprising an opening for a hydration tube and a hydration mouth piece.
Figure 4A:
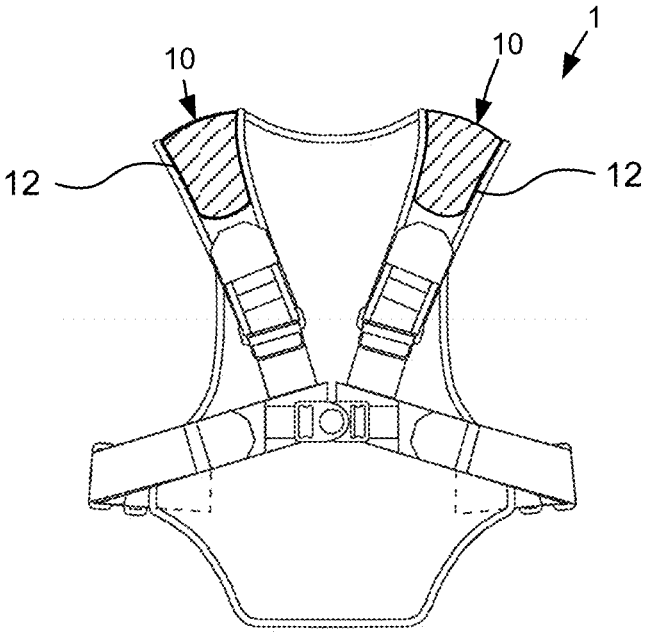
FIG. 4A is a front view of a backpack comprising two body heated compartments at shoulder straps of the backpack.
Figure 4B:
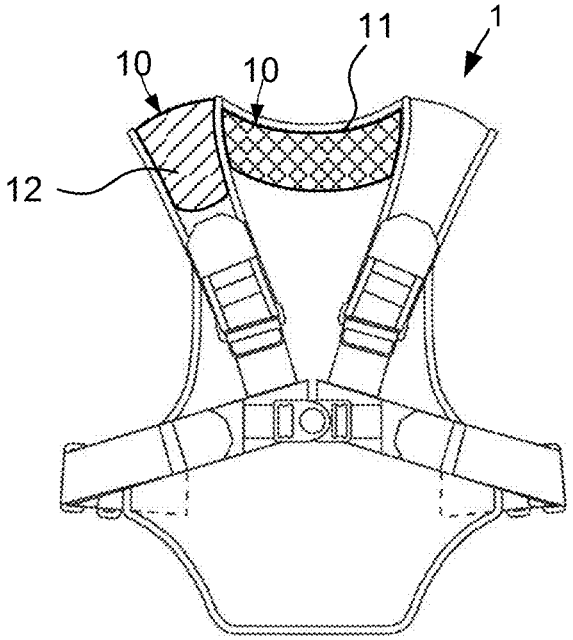
FIG. 4B is a front view of a backpack comprising two body heated compartments, one at a shoulder strap and one at a sack of the backpack.

In an example, illustrated in e.g. FIG. 3, the body heated compartment 10 comprises an opening 15. The opening 15 may be of any size. In an example, the opening 15 is large enough to receive a mobile phone. In another example, illustrated in FIG. 4, the opening 15 is large enough to eject a hydration tube 30 and a mouth piece 31 out from the body heated compartment 10 so that the user can drink when de-hydrated.

In an example, the opening 15 is arranged at an end of the shoulder strap. This may be at the top of the shoulder strap and the opening 15 can then be configured to receive the hydration tube 30 at the top of the shoulder strap from e.g. the sack of the backpack 1. Thus, the hydration tube 30 may exit the sack of the backpack 1, enter into the opening 15 at the top of the shoulder strap and be placed inside the body heated compartment 10 to be heated and/or be kept from freezing. The user may then pull out the hydration tube 30 and mouth piece 31 from the top of the shoulder when drinking.

In another example, the hydration tube 30 may also be completely protected from an outside of the backpack 1 when it is routed from e.g. the sack of the backpack 1 to the body heated compartment 10 arranged at the shoulder strap. In this way there may be a first opening 15 or channel extending internally in the backpack 1 and a second opening 15 arranged at the side of the body heated compartment 10, as illustrated in e.g. FIG. 3, for the user to drink from when de-hydrated. Hence, the opening 15 may also be arranged at a side of the shoulder strap and in some examples the backpack 1 comprises a plurality of openings 15.

In some examples, the opening 15 is re-closable. The opening 15 may be re-closable by use of a zipper mechanism, illustrated e.g. in FIG. 3, Hook-and-loop fasteners or other commonly known re-closable mechanisms. In some examples, the opening 15 or re-closable opening 15 is arranged facing away from the user, when worn, on the wind and heat insulating material 12 and/or facing inward towards the user, when worn, on the heat transfer material 11.

The opening 15 or re-closable opening 15 may also be arranged such that the opening starts on the side of the shoulder strap or body heated compartment 10 and then extend over to facing away from the user on the wind and heat insulating material 12 or a center of the shoulder strap.

Illustrated in e.g. FIGS. 1 and 2, at least one shoulder strap of the backpack 1 comprises the body heated compartment 10. In some examples, both of the shoulder straps comprises body heated compartments 10, illustrated in FIG. 5A.

The body heated compartment 10, can also be arranged on other places of the backpack 1 such as on the sack of the backpack 1. For example, the body heated compartment 10 can be arranged at a top of the sack, between the shoulders of the user, illustrated in FIG. 3B. Such body heated compartment 10 may then hold and keep a hydration bladder from freezing.

Figure 5:
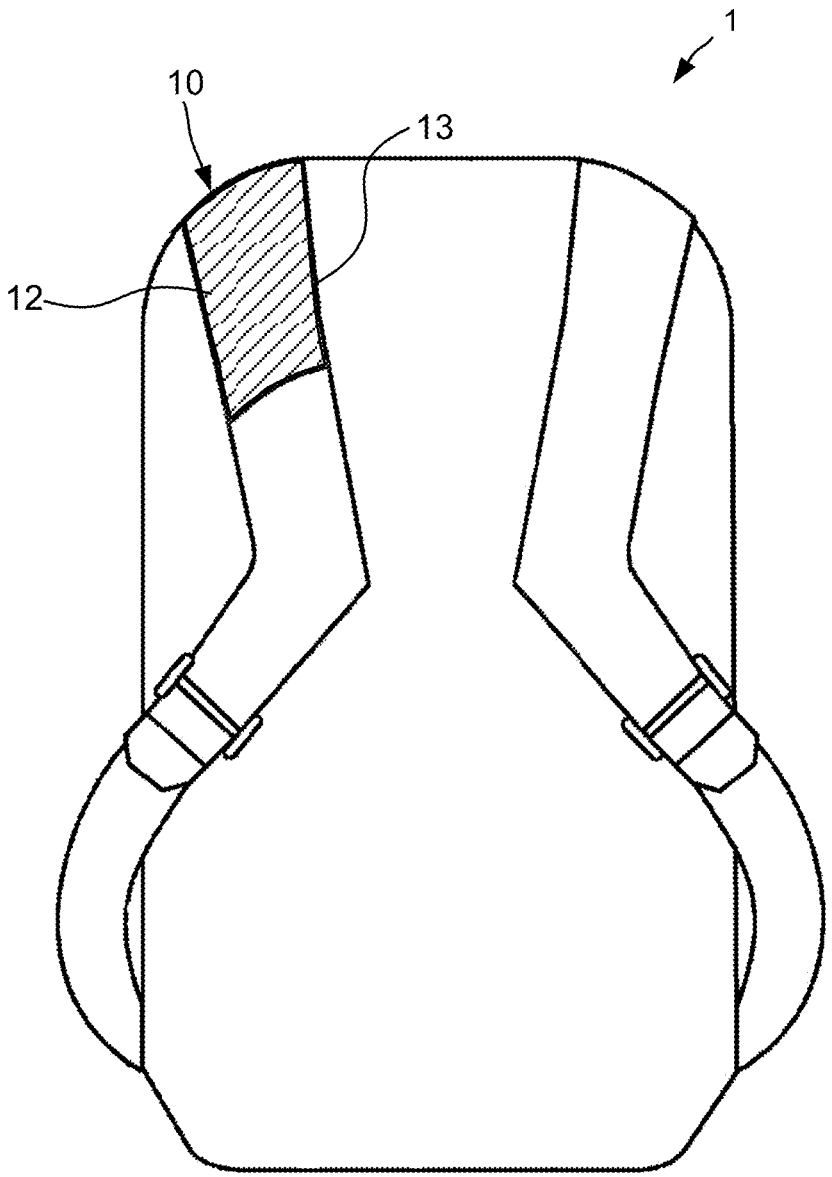
FIG. 5 is a front view of a backpack comprising a body heated compartments and two shoulder straps.

Illustrated in e.g. FIGS. 1 and 5A and 5B, is examples of the backpack 1 further comprising at least two waist straps. The waist straps are connected to the shoulder straps and the waist straps are re-connectable to each other. The backpack may of course have any number of shoulder straps such as one or two as e.g. illustrated in FIG. 6.

The backpack may also comprise any number of waist straps and a connection between the waist straps and shoulder straps may of course vary as well such as fixed connected, integrated or re-connectable. A connection between pairs of the shoulder and waist straps may also vary between being connectable or re-connectable by a buckle located at the waist strap or the shoulder strap or in a region in between.

Figure 6:
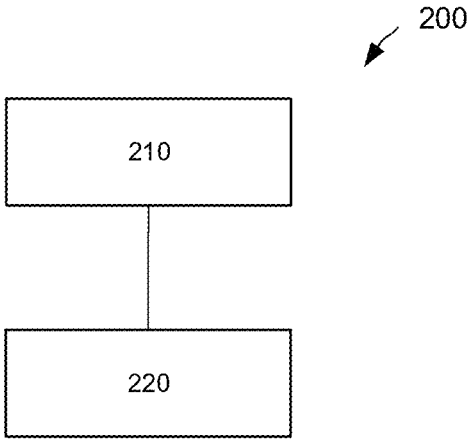
FIG. 6 is a flowchart of a method of producing a backpack comprising a body heated compartment.

In an example, illustrated in FIG. 6, a flowchart of a method 200 of producing the backpack 1 comprising the body heated compartment 10 is disclosed. The method 200 comprises forming 210 the body heated compartment 10 by use of the wind and heat insulating material 12. And, arranging 220 the seal 13 at the body heated compartment 10, the seal 13 is arranged and configured to contact the user of the backpack 1 such that at least partly sealing the body heated compartment 10 against the user.

In an example, the wind and heat insulating material 12 are connected to the seal 13 by being sewn together. In an example the wind and heat insulating material and the seal 13 are joined together by ultrasonic welding or gluing. The heat transfer material 11 may also be connected in a similar fashion to the wind and heat insulating material 12 and/or the seal 13.

Production of backpacks 1 are well known and will therefore not be discussed in further detail.

From the description above follows that, although various examples of the invention have been described and shown, the invention is not restricted thereto, but may also be embodied in other ways within the scope of the subject-matter defined in the following claims.

The invention claimed is:

1. A backpack comprising;

a body heated compartment comprising a wind and heat insulating material;

a seal connected to the body heated compartment, the seal configured to press against a user of the backpack thereby at least partly sealing the body heated compartment against the user, wherein the seal comprises an outer fabric and internal padding; and at least two waist straps connected to shoulder straps, the waist straps configured to be re-connectable to each other.

2. A backpack according to claim 1, wherein the seal is configured to be flexible, such that the seal will flex towards the user when the body heated compartment is stretched.

3. A backpack according to claim 1, wherein at least one shoulder strap of the backpack comprises the body heated compartment.

4. A backpack according to claim 1, wherein the wind and heat insulating material comprises a material selected from the group consisting of a biaxially-oriented polyethylene terephthalate, a metalized biaxially-oriented polyethylene terephthalate, an ultra-high-molecular-weight polyethylene, a stretched polytetrafluoroethylene, a neoprene, tarpaulin, a chlorosulfonated polyethylene synthetic rubber, a nylon, and a polyester.

5. The backpack according to claim 1, wherein the seal is an oblique end.

6. The backpack according to claim 1, wherein the seal has an enlarged contact surface configured to improve the contact between the user and the body heated compartment.

7. The backpack according to claim 1, wherein the backpack does not contain a heat source.

8. A backpack according to claim 1, further comprising a heat transfer material that allows body heat to pass through, the heat transfer material arranged closer to the user than the wind and heat insulating material when the backpack is worn by the user.

9. A backpack according to claim 8, wherein the wind and heat insulating material is connected with the heat transfer material thereby forming the body heated compartment.

10. A backpack according to claim 9, wherein the wind and heat insulating material is connected with the heat transfer material by being sewn together.

11. A backpack according to claim 1, wherein the body heated compartment comprises an opening.

12. A backpack according to claim 11, wherein the opening is re-closable.

13. A backpack according to claim 11, wherein the opening is arranged at an end of a shoulder strap.

14. A backpack according to claim 11, wherein the opening is arranged at a side of a shoulder strap.

15. A method for producing a backpack comprising a body heated compartment, comprising:

forming a body heated compartment by use of a wind and heat insulating material; and connecting a seal to the body heated compartment, the seal connected and configured to press against a user of the backpack such that the body heated compartment is at least partially sealed against the user, wherein the seal comprises an outer fabric and internal padding; and wherein the backpack comprises at least two waist straps, the waist straps connected to shoulder straps, the waist straps configured to be re-connectable to each other.

16. The method according to claim 15, wherein the seal is an oblique end.

17. The method according to claim 15, wherein the seal has an enlarged contact surface configured to improve the contact between the user and the body heated compartment.

18. A method for producing a backpack according to claim 15, wherein the body heated compartment is formed by connecting the wind and heat insulating material with a heat transfer material.

19. A method for producing a backpack according to claim 18, wherein the heat transfer material and the wind and heat insulating material are connected to each other by being sewn together.

* * * * *